United States Patent [19]

Adair

[11] Patent Number: 4,691,549

[45] Date of Patent: Sep. 8, 1987

[54] APPARATUS FOR REMOVING LIQUID FROM A STRIP IN A ROLLING MILL AND METHOD THEREOF

[75] Inventor: James R. Adair, Mt. Lebanon, Pa.

[73] Assignee: United Engineering Rolling Mills, Inc., Pittsburgh, Pa.

[21] Appl. No.: 669,142

[22] Filed: Nov. 7, 1984

Related U.S. Application Data

[63] Continuation of Ser. No. 334,192, Dec. 24, 1981, abandoned.

[51] Int. Cl.[4] ..... B21B 27/10; B21B 45/02; B21B 9/00

[52] U.S. Cl. ..... 72/38; 72/39; 72/45; 72/201; 72/236

[58] Field of Search ..... 15/306 A, 316 R, 345; 72/38, 39, 41, 43–45, 201, 202, 236; 134/64 R, 122 R, 198; 266/113

[56] References Cited

U.S. PATENT DOCUMENTS

| | | | |
|---|---|---|---|
| 1,560,749 | 11/1925 | Witherow | 72/39 |
| 1,739,593 | 12/1929 | Inglefield et al. | 15/306 A |
| 1,994,721 | 3/1935 | Lorig et al. | 72/201 |
| 2,050,046 | 8/1936 | Everling | 72/236 |
| 2,067,514 | 1/1937 | Trinks | 72/202 |
| 2,230,897 | 2/1941 | McBain et al. | 72/201 |
| 3,192,752 | 7/1965 | Dowd et al. | 72/45 |
| 4,061,010 | 12/1977 | Stock et al. | 72/201 |
| 4,247,047 | 1/1981 | Schaming | 72/201 X |
| 4,272,976 | 6/1981 | Pizzedaz | 72/45 |
| 4,400,961 | 8/1983 | Schaming | 72/201 |

FOREIGN PATENT DOCUMENTS

| | | | |
|---|---|---|---|
| 55-22434 | 2/1980 | Japan | 72/201 |
| 431027 | 6/1935 | United Kingdom | 72/44 |
| 1481022 | 7/1977 | United Kingdom | 15/306 A |

OTHER PUBLICATIONS

European Patent Application #0010966, Thomas Hope, published May 1980.

*Primary Examiner*—E. Michael Combs
*Attorney, Agent, or Firm*—Arnold B. Silverman; Suzanne Kikel

[57] ABSTRACT

A substantial amount of liquid lubricant used in a cold strip rolling mill is prevented from passing between the area of the work roll necks and work roll bodies not in contact with a strip by locating in a strip guiding means on the entry side adjacent both edges of the strip, several zoned air nozzles which delivery a positive pressure to force the liquid away from this area, in a direction toward the center of the strip and rolls, and which nozzles are controlled according to the width of strip being rolled. The relatively small amount of liquid finding its way onto the delivery side is removed from the strip by providing in the strip guiding means both positive and negative air pressure means located above and below the strip, and negatively pressurized longitudinal enclosures located adjacent both edges of the strip and the said area.

27 Claims, 10 Drawing Figures

APPARATUS FOR REMOVING LIQUID FROM A STRIP IN A ROLLING MILL AND METHOD THEREOF

This is a continuation of application Ser. No. 334,192 filed Dec. 24, 1981, abandoned.

BACKGROUND OF THE INVENTION

This invention relates to the rolling of a metal strip such as aluminum strip in a rolling mill stand and to a means for preventing a substantial amount of liquid applied to the rolls from entering into a gap in a non-rolling area of the work rolls while the strip is being rolled, and the removal of any liquid finding its way to the delivery side which may be through the non-rolling area.

In the cold rolling of metal strip, such as aluminum, liquid lubricant or coolant is applied to the work rolls and to the strip for a number of reasons, some of which are: to reduce the wear of the work rolls; to improve the surface quality of the strip; to reduce frictional heat generated during the rolling process, etc. The coolant applied to the work rolls lands onto the top and bottom surfaces of the strip. Usually this coolant or lubricant is an oil-in-water emulsion. If this water base liquid remains on the surface of the strip for any length of time it has a tendency to stain or mar the strip, which condition is undesirable for many commercial purposes.

Therefore, as disclosed in U.S. Pat. No. 3,192,752 wherein upon the strip's exiting from a four stand continuous four-high mill and prior to the coiling of the strip, a means and method has been devised to remove as much lubricant as possible from the strip's surfaces. This is done by arranging a plurality of air jets above and below the strip and directing these jets onto the strip and adjacent the work rolls on both sides of the strip in a manner to blow the rolling lubricant and any free water off the sides of the strip toward the sides of the mill where an exhaust system collects and withdraws the air as well as the emulsion and water. Further on down the mill line and still prior to the recoiling of the strip, again air is applied to the top and bottom of the strip while an exhaust system removes the liquid emulsion.

Several disadvantages and problems arise from the design disclosed in the '752 patent which the present invention at least substantially resolves. One of the limitations of the '752 design is that on the delivery end of the mill a considerable amount of liquid remains on the strip after it has passed beyond the air jets.

It was concluded that this condition was due to the following:

As is known in the rolling process, coolant is applied to the work rolls prior to the strip's entry into a stand of the mill. Since the coolant cannot pass between the rolls in the area engaging the strip there is a tendency to create a puddle or a buildup on top of the strip immediately adjacent the roll bite on the entry side. Some of this buildup of liquid runs off on both sides of the strip and finds its way onto the delivery side of the stand. One way in which this happens is that the liquid passes through the rolls in the open space of the roll gap extending from the edges of the strip outwardly toward the roll necks. The rotation of the rolls results in the coolant being thrown into the air and landing on the strip downstream of the air jet system of the '752 patent. Therefore, a considerable amount of liquid is on the strip even after the strip has passed through the air jet area.

In essence, the air jet system of the '752 patent does not remove most of the liquid off of the strip when it is most advantageous to do so.

SUMMARY OF THE INVENTION

It is, therefore, an object of the present invention to provide a means and a method to retain and remove from the strip most of the liquid on the entry side and remove from the strip the remaining liquid on the delivery side of either a continuous tandem rolling mill or a single stand of a rolling mill so that the rolling area remains free from excessive liquid, thereby preventing any marring to the surfaces of the strip.

It is a further object of the present invention to prevent the liquid from escaping from the entry side of the mill to the delivery side, and the removal of any liquid which passes through the rolls onto the delivery side.

A still further object of the present invention is to create a clean and tidy working area on both the entry and the delivery sides, making it conducive to the operator's inspection of the shape and appearance of the strip exiting from the stand.

And yet a still further object of the present invention is to provide a method and an apparatus for using the method, the apparatus being used in a strip rolling mill stand having a strip entry and a strip delivery side thereof wherein a strip is reduced in a rolling area between work rolls defining a roll bite and a strip passline along which strip travels generally horizontally and a non-rolling area where a gap is created from edges of said strip outwardly toward the ends of said work rolls and wherein liquid lubricant applied to said rolls on said entry side accumulates on the upper surface of said strip on said entry side, comprising: lubricant directing means having a support mountable adjacent to said non-rolling area on the entry side of said mill and including pressurized medium applying means carried by said support located in the vicinity of the edges of said strip having means for directing pressurized medium across at least a portion of said upper surface of said strip in a manner to force said accumulated liquid toward the center of said strip and prevent it from falling off the edges of said strip.

These and other objects of the present invention will become more apparent when the following description is read along with the accompanying drawings of which:

DETAILED DESCRIPTION

Figure 1:
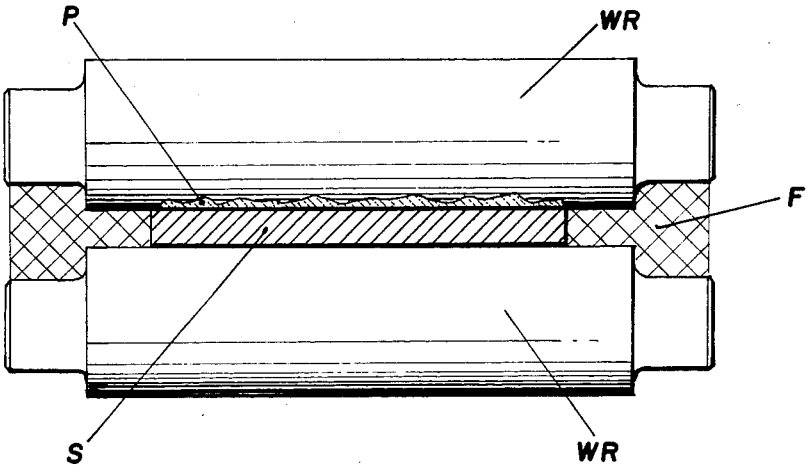
FIG. 1 is a schematic showing in exaggerated form a strip between the work rolls.

FIG. 1 illustrates the basic problem of a build-up occurring when coolant is applied to the strip on the entry side. This view is seen if one looks into the mill from the entry side while the strip S travels between the upper and lower work rolls WR. Crosshatched lines indicate in exaggerated form a gap or field F defining a non-working area between the edges of the strip and the ends of the work rolls. On the portion of the strip S immediately preceding rolling thereof an accumulation or puddle P of lubricant occurs. The continued action of the strip travelling between the work rolls causes this lubricant to flow down alongside the edges of the strip to make its way into field F and onto the delivery side of the mill.

FIGS. 2 through 10 illustrate the present invention. A four-high stand of a rolling mill is shown. It is to be noted that the system of the present invention can be used in conjunction with a single stand or several stands of a continuous tandem mill and the stand or stands may consist of more or less than four rolls. The long arrow in several figures of FIGS. 2 through 10 indicate the direction of the strip's travel.

It will be further appreciated that many of the components of the rolling mill stand and the rolling mill per se are well known in the art.

Figure 2:
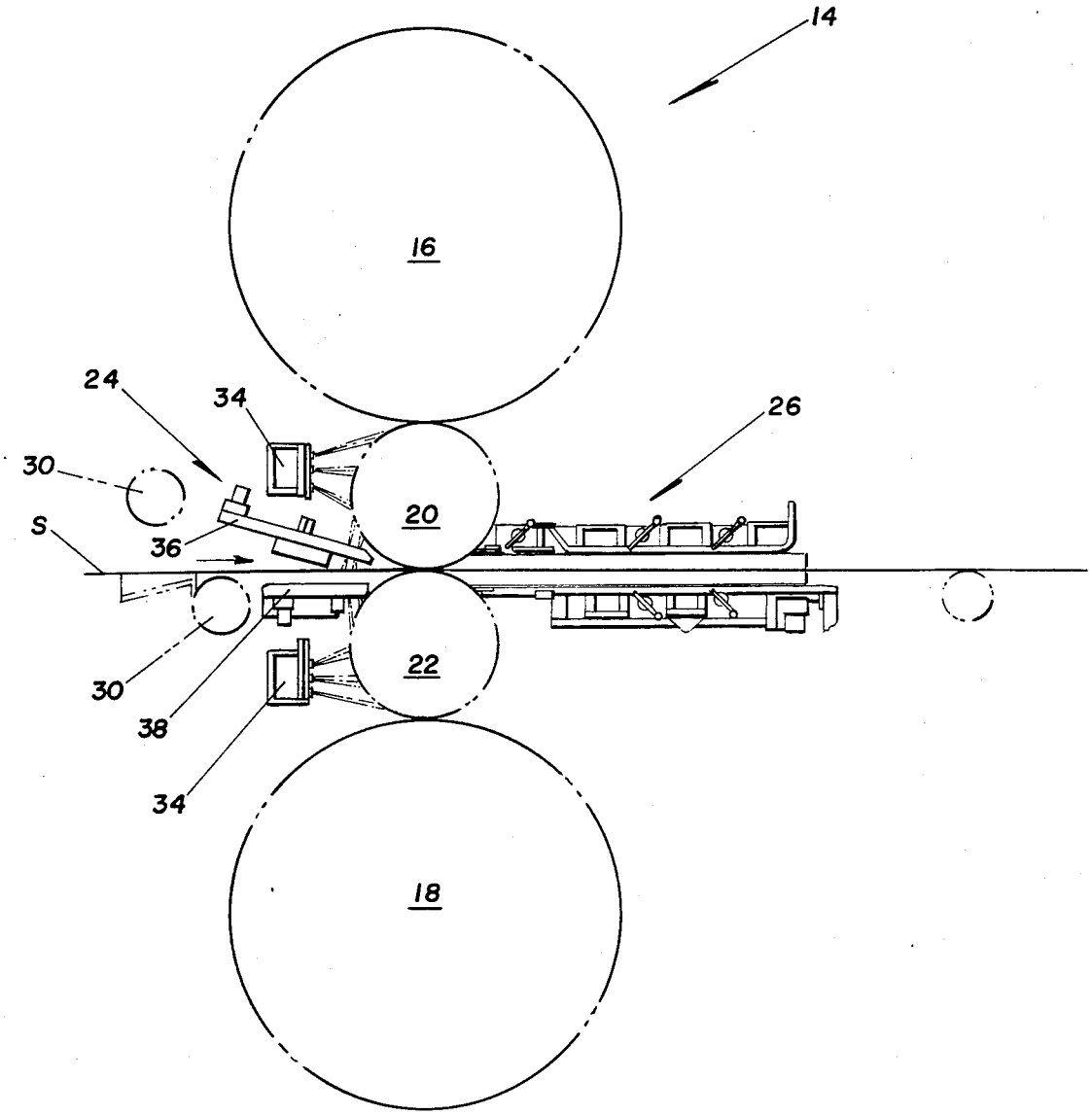
FIG. 2 is a schematic, elevational a view of a 4-high roll stand employing the present invention in the roll stand.
Figure 3:
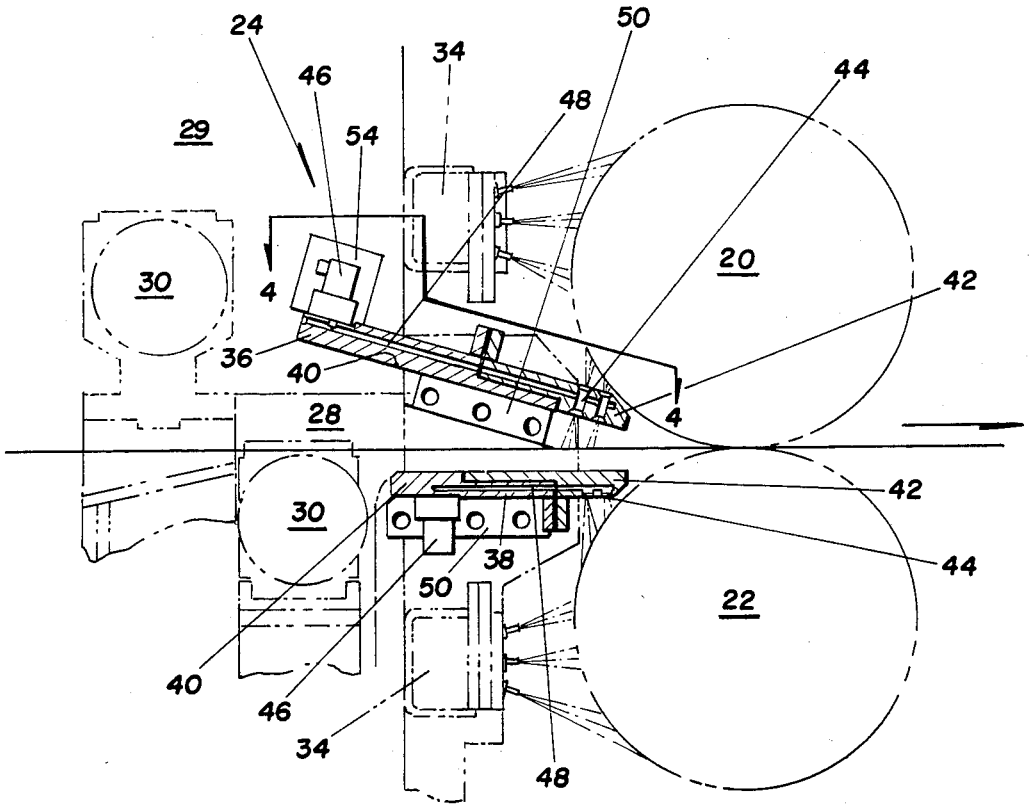
FIG. 3 is an elevational partly cross-sectional view of a strip entry guide incorporating the present invention on the entry side of the stand.

Of FIGS. 2 through 10, in describing the present invention FIG. 2 will be referred to first. A roll stand 14 of a cold rolling mill has two back-up rolls 16, 18 supporting two work rolls 20, 22 which form a roll bite through which an aluminum strip S passes along the passline of the stand for reduction. The area of the rolls in contact with the strip is the rolling area, and that not in contact is referred to as the non-rolling area. Located adjacent to work rolls 20, 22 are entry strip guiding means 24 and delivery strip guiding means 26, which guide the strip between the work rolls along the passline of the mill. Strip guiding means 24 on the entry side of the stand 14 is mounted to a bridle roll assembly 28 in which FIG. 2 and FIG. 3 shows two rolls 30 thereof, and which bridle is movable between housing posts (one indicated at 29 on the entry side) toward and away from the roll stand by means, non shown. Strip guiding means 26 is mounted to the housing post of the delivery side of the stand 14 (one of which is shown at 32 in FIG. 5) in a manner to be discussed later for movement in a horizontal direction towards and away from the rolls and in a vertical direction towards and away from the strip. Coolant or lubricant is applied to the work rolls 20, 22 by spray units 34 located on the entry side of the stand. After the strip exits from between the work rolls, it either passes to another stand or is coiled on a coiler (not shown).

As already mentioned, a constant problem in the cold reduction of metal strip, particularly aluminum, involves the accumulation of lubricant from spray units 34 occurring on the strip prior to the strip entering the roll bite. In the present invention, positive medium, such as pressurized air or fluid from strip guide means 24 retains most of this accumulated liquid on the strip prior to the strip entering the roll bite, and any atomized lubricant escaping to the delivery side and landing onto the strip due to the rotation of the rolls is removed by both positive and negative air pressures applied by the strip guiding means 26 on the delivery side of the mill.

Figure 4:
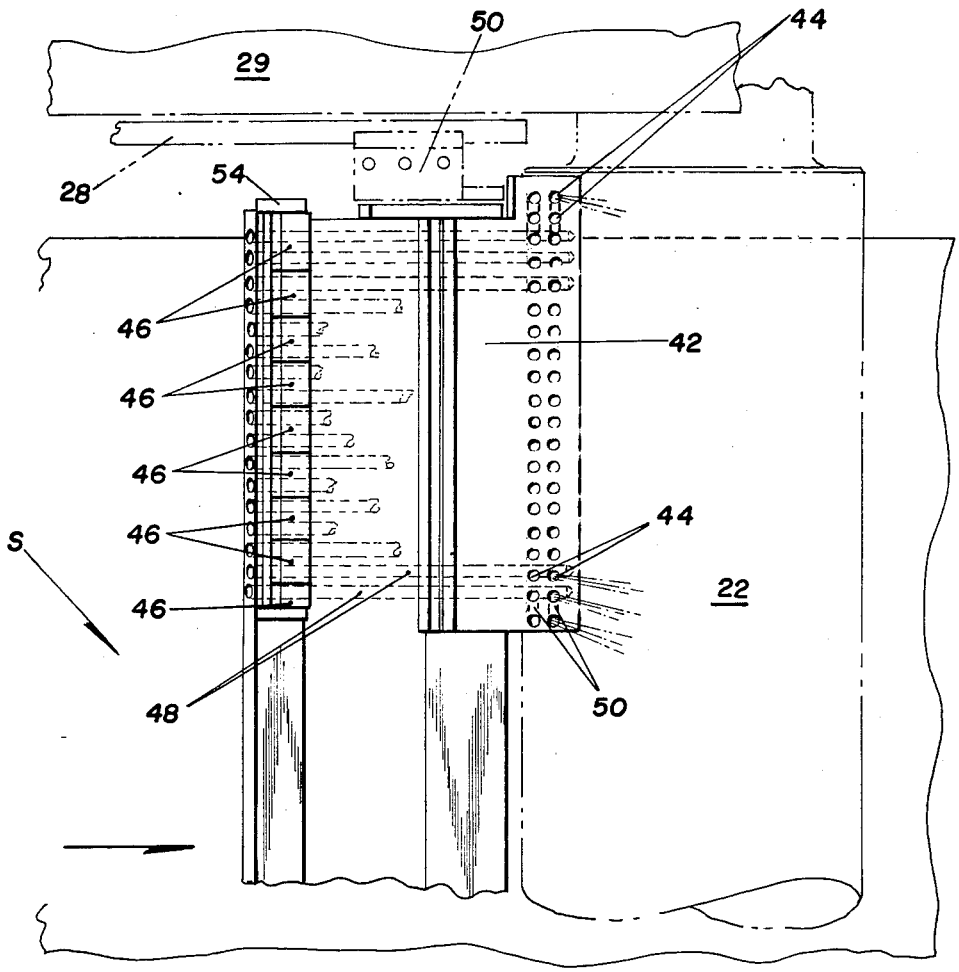
FIG. 4 is a sectional view of the top portion of the strip entry guide taken along lines 4—4 of FIG. 3.

FIGS. 3 and 4 show in greater detail the entry strip guiding means 24. It consists of upper portion 36 and lower portion 38 between which the strip travels. Both these portions 36, 38 consist of a member 40 extending the width of the housing posts 29. On both sides of member 40 along the ends of the roll bodies of work rolls 20, 22 is a nozzle assembly member 42 which is machined to be fitted and bolted into member 40, and which consists of two rows of nozzles running parallel to the roll body surfaces (FIG. 4). The length of nozzle assembly 42 is such as to accommodate both the maximum and minimum width strip. As can be seen in FIG. 3 the opening of nozzles 44 in upper portion 36 extends entirely through member 42, whereas those of lower portion 38 extend a short distance downwardly onto the underside of member 42. The openings of nozzles 44 are angled in such a manner as to deliver positive air pressure in a direction towards the center of the rolls and the strip. This direction is clearly indicated by the three converging lines extending from the nozzles 44 in FIG. 4. The nozzles in upper portion 36 direct air against both the top work roll surface and along the outer top surface or edges of the strip, and the nozzles in lower portion 38 direct positive air to the surface of the lower work roll 22. The nozzles 44 are angled towards the center of the strip and rolls so that the lubricant is caused to remain on top the strip and on the work rolls.

Mounted to the other end of members 40 are a number of air solenoid valves 46. FIG. 4 shows the air solenoid valves 46 which are connected to none or more drilled longitudinal channels, which in turn, communicate with two nozzles 44. As seen in FIG. 4 the nozzles located on the extreme ends of the nozzle assembly member 42 are interconnected to longitudinal channels 48 through traverse channels 50.

Member 40 of upper portion 36 is bolted to the side of the bridle assembly 28 through a bracket 52. For simplification, only one end of member 40 is shown, but it is to be understood that the other end of this member 40 is symmetrical about the centerline of the strip. It is also to be understood that the construction and arrangement of the lower portion 38 and its mounting to the bridle, although not shown in a plan view, is similar to that of the upper portion 36.

Each of the air solenoid valves 46 can be regulated to deliver positive air pressure according to the width of strip being rolled.

For instance, as the maximum width strip is being rolled thereby creating a minimum length of gap from the edges of the strip to the ends of the roll bodies, the nozzles at the far end of the work rolls and strip will be operated since even though a minimum length of gap exists, it is still desirable to prevent lubricant from leaving the ends of the two work roll bodies and to avoid the strip nozzles 44 from removing too much lubricant off of the strip which is required for rolling, particularly as to the upper guide assembly portion 36. If the minimum width of strip is rolled thereby creating a maximum length of gap then all the nozzles will be operated. In this case, the roll nozzles 44 allow their maximum effectiveness in preventing lubricant escaping from the ends of the roll bodies. In both instances the nozzles are selectively operated through a control 54 to deliver positive air pressure to force the lubricant in a direction toward the center of the rolls, and in the case of the upper nozzle assembly 42, towards the center of the strip. Most of the accumulated liquid on top of the strip is caused to be carried away from the rolling area in a direction opposite to that of the strip's travel away from the rotating elements of the rolling area.

As mentioned previously, from the edge of the strip outwardly along the length of the roll, a gap or non-rolling area is formed which would under ordinary circumstances permit lubricant to pass between the work rolls onto the delivery side of the stand. Due to the present invention and the selectability of the operation of the air valves notwithstanding the width of the strip, positive air pressure is applied along this roll gap along the length of the rolls to direct the lubricant to the center area of the strip and rolls thereby preventing a substantial amount of liquid from leaving the entry side of the stand.

For efficiency, the nozzle-air valve arrangement of the lower entry guide portion 38 would be operated in phase with the nozzle-air valve arrangement of the upper entry guide portion 36.

FIGS. 5 through 10 will be referred to in describing the strip guiding means 26 on the delivery side of the stand 14. Again for simplicity, FIGS. 6, 7, 9 and 10 show only one side of the delivery guiding system approximately along the centerline of the strip, and it is to be understood that the delivery strip guiding system is symmetrical about this centerline.

Figure 5:
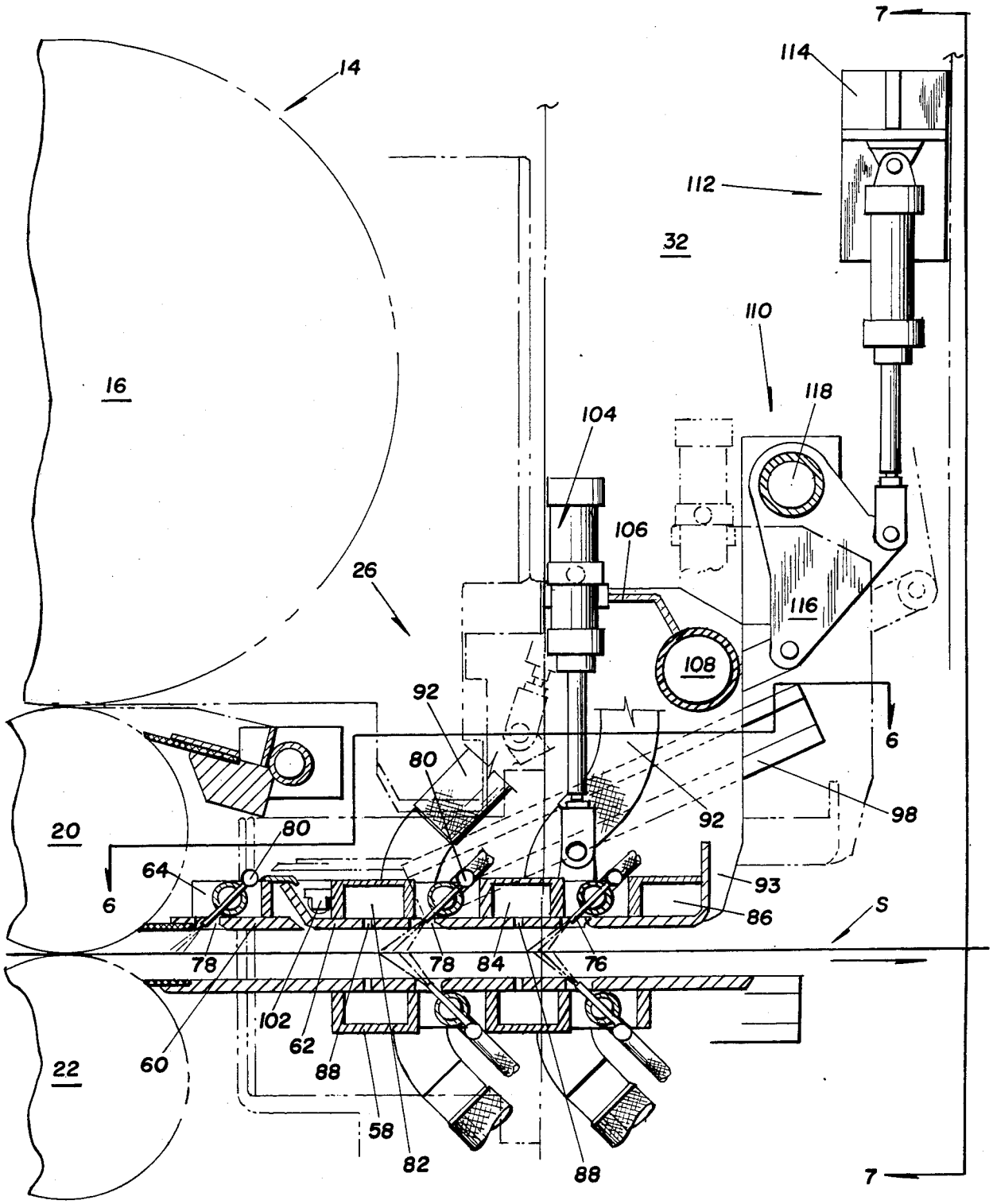
FIG. 5 is an elevational partly sectional view of a strip delivery guide on the delivery side of the stand incorporating the present invention.

A general overall design of the strip delivery guiding means of the present invention is shown in FIG. 5. It consists of an upper and a lower portion 56, 58, respectively, which portions guide the strip passing through the rolling area onto the delivery side.

A detailed description of the top portion 56 of delivery guide will be given first. In referring to FIGS. 5, 6 and 7 top portion 56 consists of two members 60, 62 which span across the width of the stand. Member 60 is located immediately adjacent the rolling area and supports an air nozzle assembly 64 consisting of a row of nozzles, which assembly 64 does not entirely extend to the centerline of the strip but whose length is such to accommodate the maximum and minimum width strip being rolled. The nozzle assembly 64 parallels those of the strip entry guiding means 24 (FIG. 4). Positive air is delivered to the nozzles of nozzle assembly 64 through line 66.

Member 62 supports two nozzle header assemblies 68, 70 each consisting of a row of nozzles separated by members 72 into three groups. Positive air is deliverd to each group by individual lines 74, and each group can be operated according to the width of strip being rolled, more about which will be explained later. Each nozzle is interconnected for passage of air to the other nozzles in their respective group by means not shown. Air pressure outlet 78 of all the nozzles of the three nozzle assemblies 64, 68, 70 extend downwardly toward the top surface of the strip through an opening 76 in members 60 and 62. Each nozzle is constructed so it can be adjusted by adjuster 80 to deliver positive air at various angles relative to the strip and the positive air pressure ejected by the nozzles is indicated by the three diverging lines extending from the nozzle shown in FIG. 6.

Figure 6:
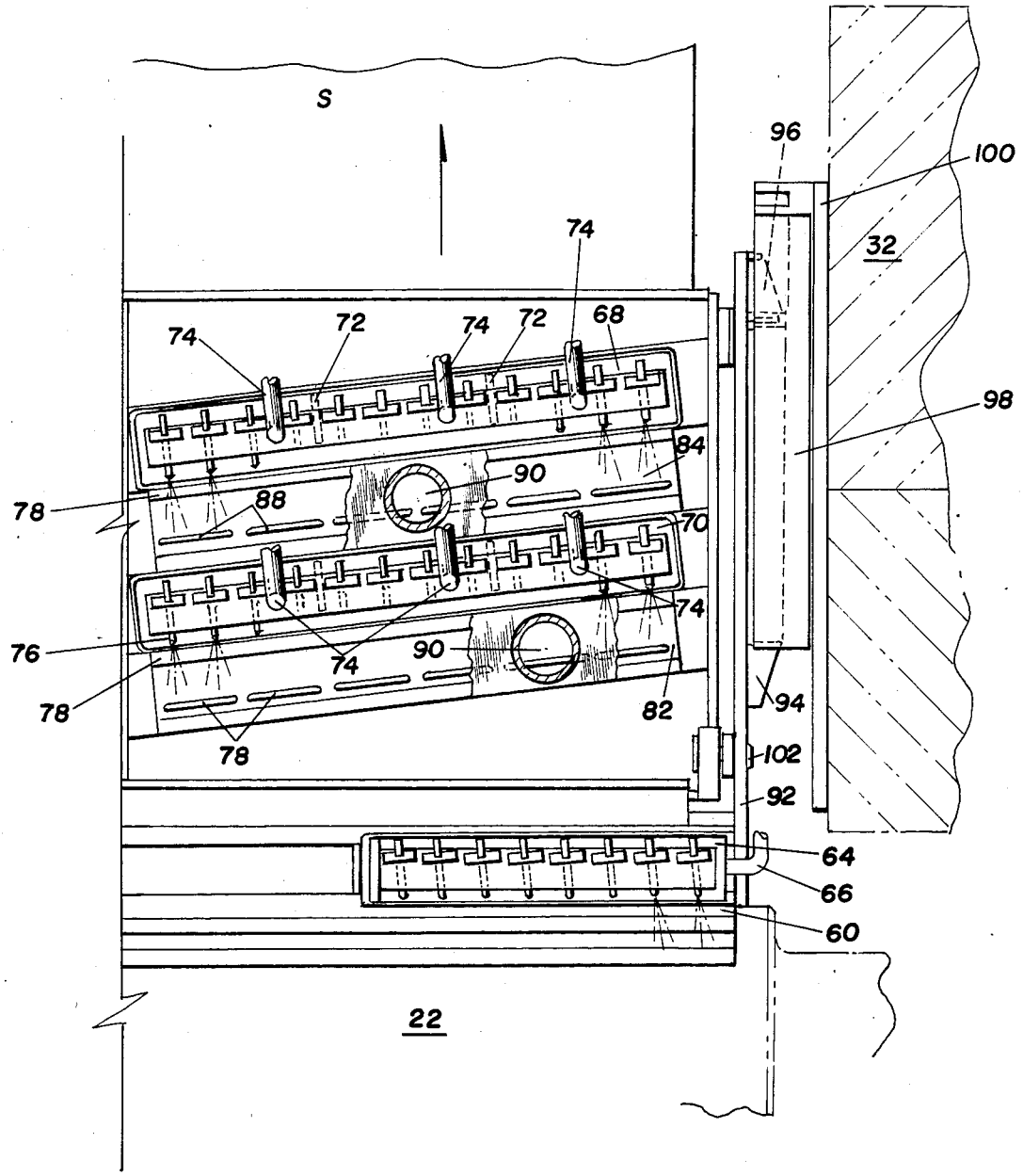
FIG. 6 is a sectional view of the top portion of the strip delivery guide taken along lines 6—6 of FIG. 5.

In addition to nozzle assemblies 68, 70, member 62 has welded thereon three enclosures 82, 84, 86, each spaced apart by nozzle assemblies 68 and 70. As seen in FIG. 6 each nozzle assembly 68, 70 is a unit and is mounted to member 62 by suitable means (not shown) and can be removed and replaced as such in the space provided between these three enclosures. In viewing FIG. 5 it can be seen that the enclosure immediately located to the left of each nozzle assembly has an opening 88 along the underside of the top portion 56 directly above the passline of the strip. In FIG. 6 these openings 88 can be seen to actually be a slot several of which run along member 62 to the centerline of the strip. Each slot 88 extends the distance occupied by two adjacent nozzles. A circular opening 90 in each enclosure provides for the connection of a hose 92 which delivers negative air pressure to the enclosures 82 and 84.

FIG. 6 indicates that nozzle header assemblies 68 & 70 and enclosures 82 and 84 slant downwardly from right to left toward the centerline of the strip. Using this centerline as a focal point the nozzle assemblies and the enclosures on the other side of member 62 would run upwardly from right to left in a similar manner as that shown, thus, the left side of member 62 is a mirror image to that of the right shown in FIG. 6. In an overall view of the top portion these nozzle assemblies and enclosures on member 62 form a chevron configuration across the width of the stand. This chevron configuration angles the nozzles in a manner that the positive air pressure forces the lubricant adhering to the top surface of the strip away from the center towards the edges of the strip. Also the nozzles of nozzle assembly 64 are angles for the same reason, i. e., to force the lubricant towards the edge of the strip.

The operation of the top portion of the strip delivery guide means is as follows. Positive air pressure is delivered through the nozzles of nozzle assemblies 64, 68 and 70 and a vacuum is created in enclosures 82 and 84. Immediately adjacent to the rolling area the nozzles of nozzle assembly 64 directs the lubricant towards the edges of the strip where it is removed by a vacuum system, more about which will be explained shortly. Nozzle assembly 70 cooperates with vacuum enclosure 82 and nozzle assembly 68 cooperates with vacuum enclosure 84 to remove the lubricant from the top surface of the strip. In addition to diverting the lubricant to the edges of the strip, the force of the positive air pressure initially loosens any adhering lubricant. It then carries this loosened lubricant along with the flow of liquid towards the edges of the strip where most of it is drawn up through suction slots 88 in enclosures 82 and 84. Members 60 and 62 are interconnected through sidewall member 92 which has projections 94 and 96 which in turn fit into a U-shaped slide 98 bolted to a plate 100 mounted on the side of the housing post 32. As seen in FIG. 6, member 62 is pivotally connected at 102 to sidewall member 92 so that through piston cylinder assembly 104 (shown in FIGS. 5 and 7), it can be pivoted relative to member 60. For simplicity, this movement is not shown in phantom in any of the FIGS. 5, 6 or 7, and would be initiated for threading of the strip through the stand. Cylinder 104 is supported through bracket 106 by a circular member 108 extending across the width of the stand which circular member is bracketed and fastened into side wall member 92 of top portion 56.

Both members 60 and 62 of top portion 56 are moved as a unit away from work rolls 20 and 22 through a linkage system 110 which is pivotally connected to piston cylinder assembly 112 located on both sides of top portion 56 (only one piston cylinder assembly 112 is shown in FIG. 6). This piston cylinder assembly 112 is mounted by bracket 114 to the side of the housing post 32 at one end and connected to a clevis member 116 of linkage system 110 at the other end. This clevis member 116 pivots on an equalizer shaft 118 extending the width of the stand and connected through bearing 120 mounted to a bracket 122 on the side of the housing. As shown in FIG. 5 slide 98 runs at an angle relative to the mill passline. Through the operation of piston cylinder assembly 114 top portion 56 moves upwardly in slide 98 in a horizontal position as seen in FIG. 5. This movement is generally initiated for work roll changing purposes.

In the discussion of the lower portion 58 of strip delivery guiding means 26 reference will be made to FIGS. 8,9 and 10. This lower portion 58 consists of nozzle assemblies 124 and 126 which, similarly to the nozzle assemblies 68 and 70 of top portion 56 consist of nozzles separated by members 128 into three groups of nozzles. In viewing FIG. 8, to the left of nozzle assemblies 124 and 126 in an enclosure 130, 132 respectively. A series of slots 133 in lower portion extend along the length of each enclosure 130 and 132, and continuous openings 134 in lower portion 58 receive air outlets of the nozzles of nozzle assemblies 124, 126. Two vacuum hoses 136 connected to circular openings 140 deliver negative air pressure to each of the vacuum enclosures 130, 132. Similar to the top portion, the nozzles and enclosures of the lower portion form a chevron configuration across the width of the stand. Positive air from the nozzles loosens the lubricant from the undersurface of the strip and forces most of it towards the edges of the strip where it is drawn downwardly away from the pass line. Both the top and bottom vacuum or negative air systems include means (not shown) which carry the liquid lubricant away from the delivery side area of the stand.

Figure 9:
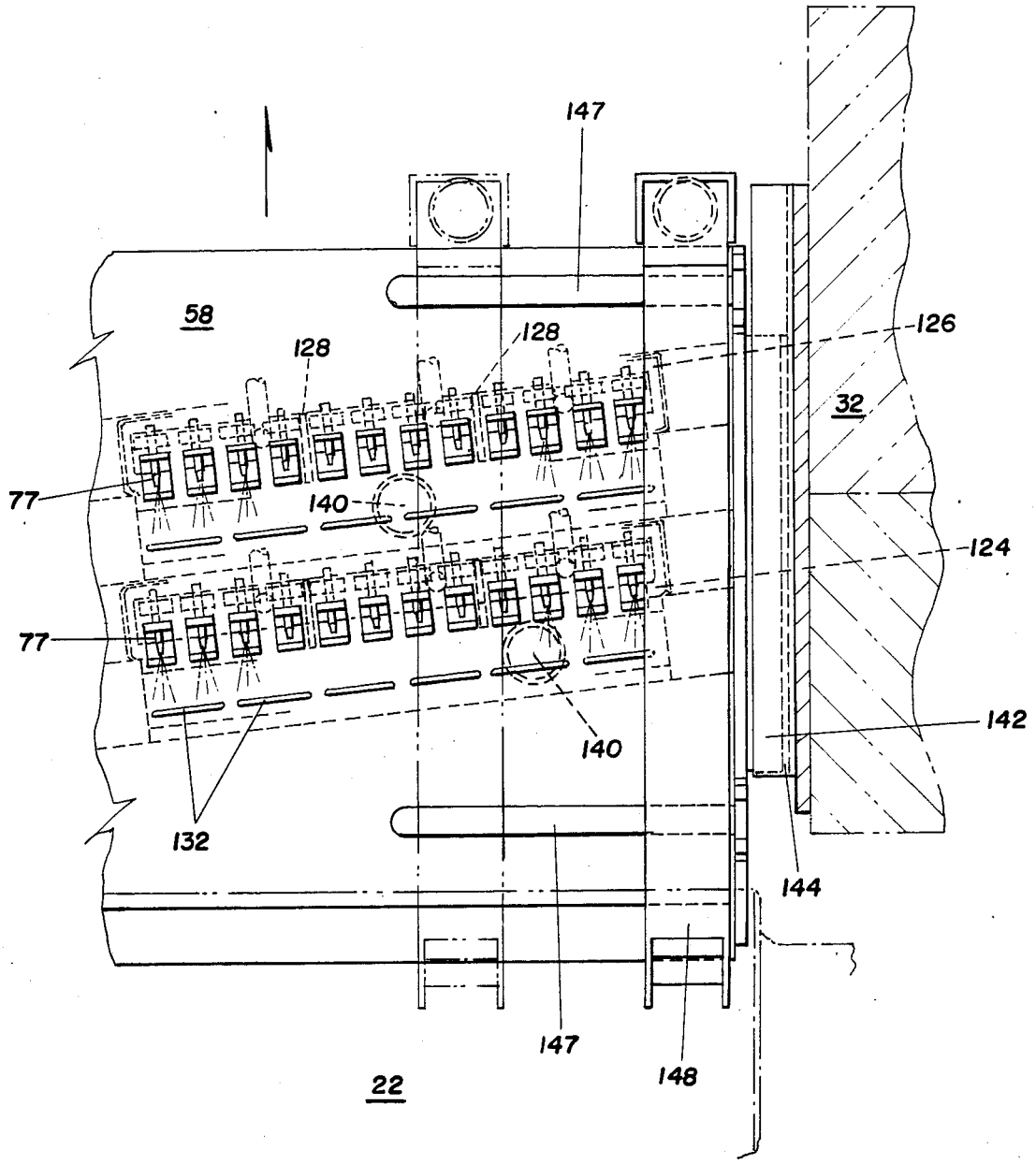
FIG. 9 is a sectional view of the bottom portion of the strip delivery guide taken along lines 9—9 of FIG. 8.
Figure 10:
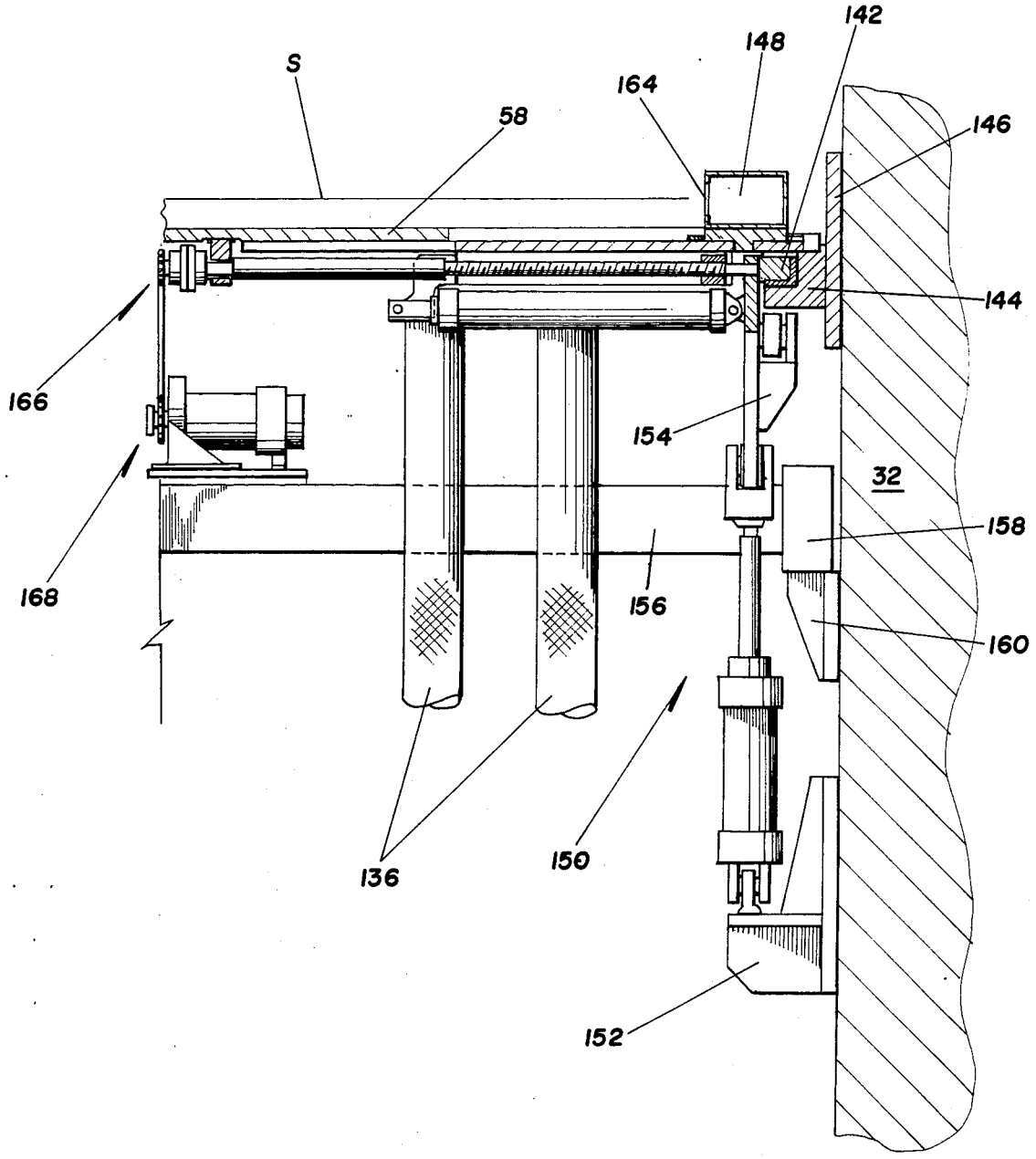
FIG. 10 is a partly sectional elevational view taken along lines 10—10 of FIG. 8.

Lower portion or member 58 has a projection 142 shown in FIGS. 9 and 10 which fit and is guided through a U-shaped slide 144 mounted through plate 146 to the side of the housing 32. Mounted in the two traverse slots 147 of lower portion 58 for traverse movement therein as shown in phanton in FIG. 9 is a rectangular vacuum enclosure 148, which extends beyond the length of lower portion 58 into the roll gap. The portion of this enclosure 148 extending between and immediately adjacent to the rolls 20 and 22 has an opening for receiving any lubricant coming between the rolls. Vacuum enclosure 148 is positioned immediately alongside the edges of the strip leaving only enough space so that the strip does not come into contact with the enclosure 148. A further discussion of the enclosure will be given shortly.

Movement of the lower portion 58 away from the rolling area is initiated through a linkage-piston cylinder assembly similar to that described for the top portion 56.

Figure 8:
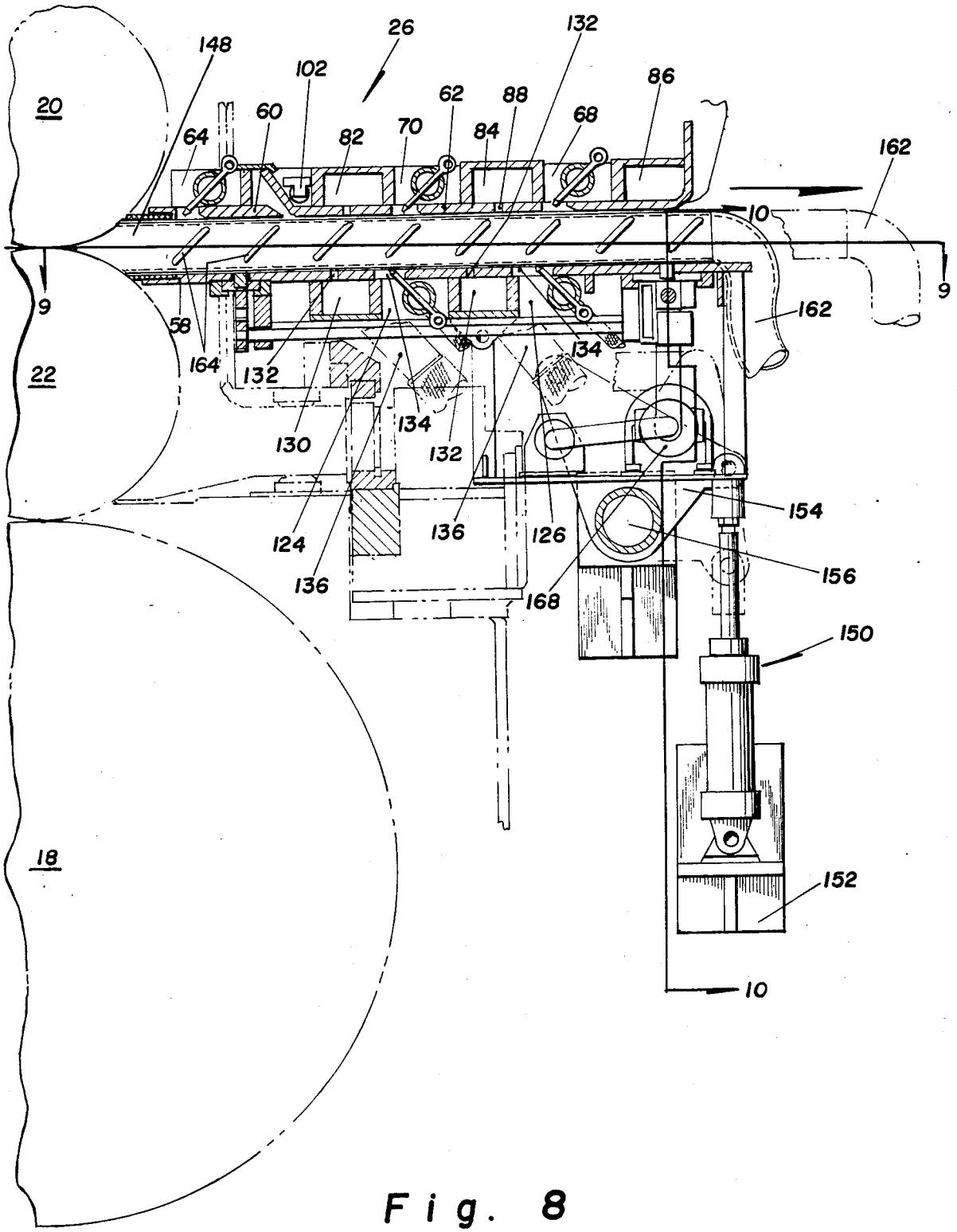
FIG. 8 is an elevational partly sectional detailed view of the bottom portion of the strip delivery guide including a longitudinal frame.

FIG. 10 shows a half portion of the section taken along lines 10—10 of FIG. 8. Piston cylinder assembly 150 is pivotally connected at one end to a bracket 152 mounted to the side of housing 32 and to a clevis member 154 at the other end. Clevis member 154 is pivotally mounted to an equalizer shaft 156 extending the width of the stand, which shaft 156 is mounted by bearing 158 and bracket 160 to the side of the housing. The effected horizontal movement of the lower portion 58 in slide 144 is partially shown in phantom line in FIG. 8.

Figure 7:
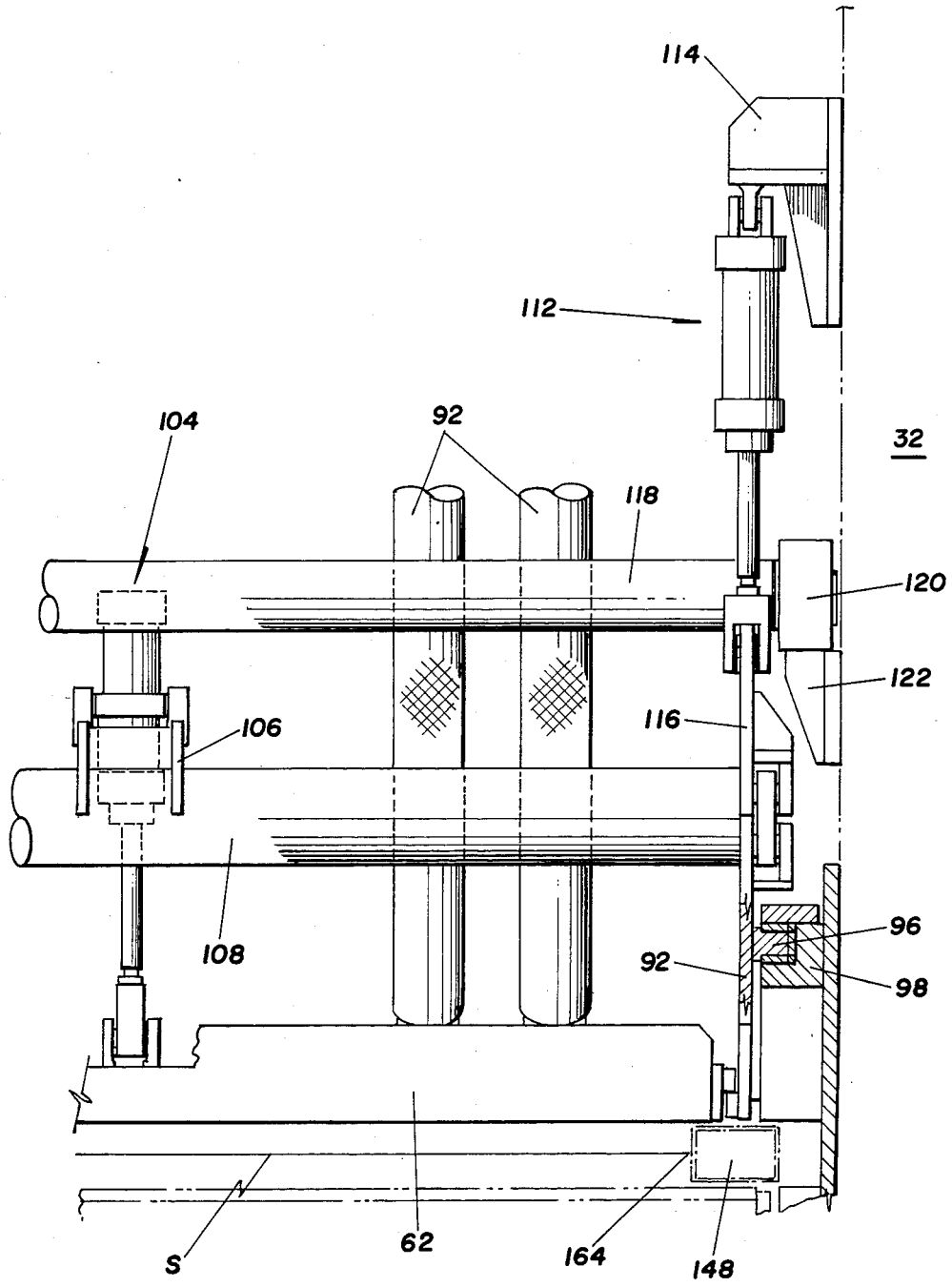
FIG. 7 is an elevational, partly sectional view taken along lines 7—7 of FIG. 5.

The precise location of rectangular box 148 relative to the edge of the strip is shown in FIGS. 7 and 10. It projects from the work rolls 20, 22 and extends beyond the length of the delivery guide means 6 as shown to the right of FIG. 9, where a hose 162 is connected thereto. On the inside of rectangular box adjacent to the edge of the strip is a series of angular slots 164. Traverse movement of rectangular box is initiated through a rack and pinion arrangement 166 powered through a coupling and motor arrangement 168 to provide width positioning of the boxes to accommodate the various strip widths. It is important to locate the enclosures 148 as close to the edges of strip as possible so that the liquid along the edges can be drawn off. All nozzles of nozzle assembly 64 are operated irrespective of the width of strip being rolled to cause the lubricant along the strip's edge to be forced into the vacuum chambers 148.

Each of the groups of nozzles in the nozzle assemblies 68, 70, 124, 126 in the upper and lower portions 56, 58 can be controlled individually or simultaneously according to the width of strip being rolled as explained for the strip guiding means 24 on the entry side of the stand. If a minimum width strip is being rolled then perhaps only the two groups located outwardly from the centerline of the strip when viewing FIGS. 5 and 9 will be operated. If a maximum width is to be rolled all groups will deliver positive air to the strip. The groups of top portion 56 corresponding with those of the lower portions 58 can either be operated in phase or out of phase.

Upon operation of the nozzle assemblies 124, 126 and enclosure systems 130, 132 of the lower portion 58, positive air against the undersurface of the strip loosens and forces the lubricant toward the edges of the strip. Enclosure 130 cooperates with nozzle assembly 124 and enclosure 132 cooperates with the nozzles of nozzle assembly 126 to draw most of the lubricant off of the under surface of the strip. Any lubricant escaping along the edges of the strip on both its top and bottom surfaces is drawn into the rectangular vacuum chambers 148 and carried away from the strip area by means, not shown.

The interrelationship and operation of all components of the present invention provides for the optimization of the removal of lubricant away from the rolling area particularly on the entry side and surfaces of the strip on the delivery side of a stand.

In accordance with the provisions of the patent statutes, I have explained the principle and operation of my invention and have illustrated and described what I consider to represent the best embodiment thereof.

I claim:

1. In a strip rolling mill stand having a strip entry and a strip delivery side thereof wherein a strip is reduced in a rolling area between work rolls defining a roll bite and a passline for the strip along which strip travels generally horizontally and a non-rolling area where a gap is created from the edges of said strip outwardly towards the ends of said work rolls, and wherein liquid lubricant applied to said rolls on said entry side tends to accumulate on the upper surface of said strip on the entry side, comprising:

strip guide means on said entry side for guiding said strip between said rolls, said strip entry guiding means having air pressure means mounted therein which pressure means is located transversely along a portion of said upper surface overlapping the edges of said strip immediately adjacent said roll bite, said air pressure means includes means associated with said strip constructed and arranged in a manner to prevent at least a substantial amount of said lubricant on said upper surface of said strip on said entry side from entering into said gap and finding its way to the delivery side of said mill stand.

2. In a strip rolling mill stand according to claim 1 wherein additional accumulation of said liquid occurs on said work rolls and said entry guiding means consists of an upper portion located above said passline and a lower portion located below said passline, and wherein said air pressure means is mounted in said portions and further includes means associated with said work rolls constructed and arranged in a manner to direct said lubricant away from said gap in a direction towards said center of said work rolls.

3. In a strip rolling mill stand according to claim 2 further comprising:

a bridle moveable parallel to said passline towards and away from said mill and, means for securing said entry guiding means to said bridle for movement therewith.

4. In a strip rolling mill stand according to claim 1 further comprising:

strip guiding means on said delivery side of said stand, said strip delivery guiding means consisting of air pressure means located transversely along a portion of said upper surface overlapping the edges of said strip immediately adjacent to said roll bite and constructed and arranged to direct lubricant on said upper surface of said strip on said delivery side in a direction away from the center of said strip towards the edges thereof.

5. In a strip rolling mill stand according to claim 4, wherein said strip guiding means on said delivery side consists of an upper portion located above said passline and a lower portion located below said passline and wherein said air pressure means is mounted in said upper portion.

6. In a strip rolling mill stand according to claim 4, wherein said air pressure means on said entry and said delivery sides consists of a series of groups of nozzles delivering positive air pressure, and means for delivering said positive air pressure to said nozzles.

7. In a strip rolling mill stand according to claim 6, wherein said means for delivering said positive air pressure on said entry side includes means mounted on said upper and said lower portions of said entry strip guiding means for selectively controlling each group of nozzles according to the width of strip being rolled.

8. In a strip rolling mill stand according to claim 7, wherein said means for selectively controlling each group of nozzles includes air solenoid valve means.

9. In a strip rolling mill stand according to claim 1, further comprising:

strip guiding means on said delivery side of said stand comprising:

an upper portion located above said passline and a lower portion located below said passline, a first air pressure means mounted in said upper and lower portions for loosening and removing any lubricant adhering to the top and bottom surfaces of said strip on said delivery side, and means connected to said first air pressure means for delivering pressurized air thereto.

10. In a strip rolling mill stand according to claim 9, inlcuding:

a second air pressure means mounted in said upper portion of said strip delivery guiding means and located transversely on both sides of said strip immediately adjacent to said roll bite constructed and arranged to direct said lubricant on said upper surface of said strip outwardly towards the edges of said strip for removal therefrom, and means connected to said second air pressure means for delivering positive air thereto.

11. In a strip rolling mill stand according to claim 9, wherein said upper and said lower portions of said delivery guiding means extend across at least the width of said strip.

12. In a strip rolling mill stand according to claim 11, wherein said first air pressure means in said strip delivery guiding means further comprises:

positive and negative air pressure means arranged across the width and along a length of said strip and constructed to cooperate in a manner so that positive air loosens said lubricant and negative air draws said loosened lubricant off of said top and bottom surfaces of said strip.

13. In a strip rolling mill stand according to claim 12, wherein said positive air pressure means consists of at least two rows of nozzles arranged transversely across the width of strip and said negative air pressure means consists of a vacuum chamber adjacent to each said row of nozzles, said rows of nozzles and said vacuum chambers forming a chevron configuration across said width of said strip.

14. In a strip rolling mill stand according to claim 13, wherein said rows of nozzles are grouped, and said positive air in each group is selectively controlled to be delivered to each group according to the width of the strip being rolled.

15. In a strip rolling mill stand according to claim 9, further comprising:

separate power means connected to said upper and lower portions of said strip delivery guiding means or moving said upper and said lower portions toward and away from said rolling area, and said upper portion toward and away from said passline, and separate slide means mounted to said stand for guiding said upper and lower portions in said movement.

16. In a strip rolling mill stand according to claim 9, further comprising:

air pressure means located on said delivery side alongside the edges of said strip for applying a negative air pressure to remove said lubricant therefrom.

17. In a strip rolling mill stand according to claim 16, further comprising:

means for transversely adjusting said negative air pressure means according to the width of strip being rolled so that said negative air pressure means is located in the vicinity adjacent to said edges of said strip.

18. In a strip rolling mill stand according to claim 16, wherein said negative air pressure means is constructed and arranged to fit into said gap of said rolling area.

19. In a strip rolling mill stand according to claim 1, wherein said means associated with said strip is constructed and arranged in a manner to direct said liquid lubricant across said upper surface away from said gap in a direction towards the center of said strip for said prevention of said liquid from entering said gap.

20. In a strip rolling mill stand having a strip entry and a strip delivery side thereof wherein a strip is reduced in a rolling area between work rolls defining a roll bite and a strip passline along which strip travels generally horizontally and a non-rolling area where a gap is created from edges of said strip outwardly towards the ends of said work rolls and wherein liquid lubricant applied to said rolls on said entry side accumulates on the upper surface of said strip on said entry side, comprising:

lubricant directing means having a support mountable adjacent to said rolling area on the entry side of said mill and including pressurized medium applying means carried by said support located in the vicinity of the strip having means for directing pressurized medium across at least a portion of the upper surface of the strip in a manner to keep said lubricant from entering into said gap and finding its way to the delivery side of said mill stand.

21. In a strip rolling mill stand having a strip entry and strip delivery side thereof wherein a strip is reduced in a rolling area between work rolls defining a roll bite and a strip passline along which strip travels generally in a horizontal position and a non-rolling area where a gap is created from the edges of said strip outwardly towards the ends of said work rolls, and wherein liquid lubricant applied to said rolls on said entry side accumulates on the upper surface and finds its way on said delivery side by passing through said gap and by being thrown into the air and landing on said strip a considerable distance downstream of said roll bite, comprising:

strip guiding means on said delivery side of said stand comprising:

first air pressure means constructed and arranged closely adjacent said rolls on the delivery side of said stand to train pressurized air in said roll gap area on the delivery side of said stand adjacent the opposite edges of said strip to keep said strip free of lubricant passing through said roll gap from said entry side to said delivery side of said mill, an upper frame located above said passline for mounting said first air pressure means close to said roll bite, a lower frame located below said passline in alignment with said upper frame, second air pressure means mounted in said upper frame downstream from said first air pressure means and mounted in said lower frame constructed and arranged to simultaneously loosen adherring lubricant previously thrown into the air in the rolling process and direct it outwardly towards said edges of said strip to symmetrically clean top and bottom surfaces of said downstream section of said strip on said delivery side, means connected to said first and second air pressure means for delivering pressurized air thereto, and means for moving said upper and lower frames towards and away from said roll bite and towards and away from said passline.

22. In a strip rolling mill stand according to claim 21, wherein said first air pressure means supplies a positive air pressure, and wherein said second air pressure means consists of positive and negative air pressure means arranged to span at least the width and along a length of said strip and constructed to cooperate in a manner so that positive air loosens said adhering lubricant and negative air draws said loosened lubricant off of said top and bottom surfaces of said strip.

23. In a strip rolling mill stand according to claim 22, wherein said first air pressure means and said positive air pressure means of said second air pressure means includes rows of nozzles arranged transversely across the width of strip, and wherein said negative air pressure means includes a vacuum chamber located adjacent to each said row of nozzles of said second air pressure means, and further comprising means for separating said rows of nozzles of said second air pressure means into groups so that positive air is selectively delivered to accommodate the width of strip being rolled.

24. In a strip rolling mill stand according to claim 21, wherein said upper frame consists of at least two members pivotally connected to each other and wherein said first air pressure means is mounted in one of said two members located closest to said roll bite, and wherein said means for moving said upper and lower frames includes means for effecting pivotal movement between said two members of said upper frame and movement of said two members of said upper frame as a unit.

25. In a strip rolling mill stand according to claim 21, wherein said first air pressure means is further constructed and arranged to be located transversely along a portion of said upper surface of said strip to direct said liquid on said strip outwardly towards the edges of said strip for removal therefrom.

26. In a metal strip rolling mill which includes at least a pair of working rolls one above the other and between which a metal strip travels on a substantially horizontal path of movement, a pair of coolant distribution headers disposed near the upstream sides of the working rolls one above and one below the metal strip, liquid coolant distribution nozzle units on said headers in communication therewith and delivering liquid coolant onto the upstream sides of the working rolls at least across the width of the metal strip, a pair or pneumatic headers extending along the bottom and top of the coolant headers, compressed air nozzle units connected with said pneumatic headers and adapted to direct the stream of compressed air onto the upstream faces of the working rolls above and below the metal strip, the compressed air nozzle streams having their axis arranged relative to the opposite ends of the working rolls to remove most of the liquid coolant from the working rolls to thereby prevent most of the liquid coolant delivered onto the upstream sides of the working rolls from passing through the rolls and downstream thereof, another pair of headers disposed slightly downstream of the working rolls, one above and one below the metal strip and spanning the width of said strip, the last-named headers having opposing evacuation slots across the top and bottom face of said strip in closely spaced relationship thereto, said evacuation slots being disposed near the upstream sides of the last named headers to evacuate their interiors, whereby the evacuation slots can remove air suspended liquid coolant particles from the regions close to the strip and last-named headers on opposite sides of the strip, and compressed air nozzle means on the last-named headers near and slightly downstream from the evacuation slots and being adapted to deliver multiple streams of compressed air onto opposite sides of the strip in somewhat upstream directions to lift liquid coolant remaining on the strip therefrom and rendering such coolant airborne in the vicinity of the evacuation slots.

27. Apparatus for substantially completely removing liquid coolant from a moving metal strip in a metal rolling mill or the like having a stand of working rolls, the apparatus comprising a first compressed air delivery nozzle means disposed near the upstream side of said roll stand and delivering multiple compressed air streams onto the working rolls with the air streams having their axes arranged relative to the rolls to thereby remove most of the liquid coolant from the working rolls at their upstream sides, and a separate and independently operable downstream liquid coolant removal means closely located to the working rolls on the downstream side of the roll stand operable for removing substantially completely any liquid coolant remaining on the metal strip downstream of the roll stand, the downstream liquid coolant removal means comprising a pair of opposing closely spaced parallel headers spanning the metal strip above and below the same, each header having an evacuation slot in its wall facing said strip near the upstream side of the header with relation to the direction of movement of the strip, means to evacuate the interiors of said headers whereby suspended coolant particles can be drawn into the headers through said slots for remote disposal, and compressed air nozzle means on the headers slightly downstream of said slots and directing streams of compressed air onto the top and bottom sides of said strip across the width of the strip with the axes of the air streams angled somewhat upstream with relation to the path of movement of the strip to lift liquid coolant from the top and bottom faces of the strip in the vicinity of said evacuation slots.

* * * * *